US009842579B1

(12) United States Patent
Pelz

(10) Patent No.: US 9,842,579 B1
(45) Date of Patent: Dec. 12, 2017

(54) PERCUSSION INSTRUMENT AND METHOD FOR DETECTING AN ATTACK POSITION OF A PERCUSSION INSTRUMENT

(71) Applicant: GEWA music GmbH, Adorf/Vogtland (DE)

(72) Inventor: Dennis Pelz, Klingenthal (DE)

(73) Assignee: GEWA music GmbH, Adorf/Vogtland (DE)

( * ) Notice: Subject to any disclaimer, the term of this patent is extended or adjusted under 35 U.S.C. 154(b) by 0 days.

(21) Appl. No.: 15/346,027

(22) Filed: Nov. 8, 2016

(30) Foreign Application Priority Data

Jun. 10, 2016 (DE) ..... 10 2016 110 751

(51) Int. Cl.
*G10H 3/14* (2006.01)
*G10D 13/02* (2006.01)

(52) U.S. Cl.
CPC ..... *G10H 3/143* (2013.01); *G10D 13/024* (2013.01); *G10H 3/146* (2013.01); *G10H 2220/525* (2013.01)

(58) Field of Classification Search
CPC ..... G10H 2220/525; G10H 2220/561
See application file for complete search history.

(56) References Cited

U.S. PATENT DOCUMENTS 5,854,436 A * 12/1998 Wernick ..... G10H 3/146 84/411 P
5,913,260 A 6/1999 Buchla
5,920,026 A * 7/1999 Yoshino ..... G10D 13/024 84/414
6,576,829 B1 * 6/2003 Hart ..... G10H 3/146 84/104
7,408,109 B1 * 8/2008 Freitas ..... G10H 3/12 84/687
8,253,001 B1 * 8/2012 Liu ..... G10D 13/02 84/411 R
2004/0083873 A1 * 5/2004 Yoshino ..... G10D 13/024 84/107
2004/0200338 A1 10/2004 Pangrle
2007/0051231 A1 * 3/2007 Fujii ..... G10D 13/027 84/723
2008/0282867 A1 * 11/2008 Liu ..... G10D 13/024 84/411 P
2011/0167992 A1 * 7/2011 Eventoff ..... G10H 1/0558 84/723

(Continued)

FOREIGN PATENT DOCUMENTS

GB 2170639 A 8/1986
WO 02/065445 A2 8/2002

OTHER PUBLICATIONS

Office Action dated Feb. 2, 2017 in the corresponding DE patent application No. 10 2016 110 751.4 (with English translation).

*Primary Examiner* — Marlon Fletcher
(74) *Attorney, Agent, or Firm* — Posz Law Group, PLC

(57) ABSTRACT

A percussion instrument, in particular electronic percussion instrument, includes at least one main attack element having at least one main attack surface and with a position detecting unit which is at least provided to detect an attack position of the main attack surface. The position detecting unit comprises at least two position detecting elements which are arranged decentrally with respect to the main attack surface, at least when the main attack surface is viewed perpendicularly.

13 Claims, 3 Drawing Sheets

(56) References Cited

U.S. PATENT DOCUMENTS

Figure 1:
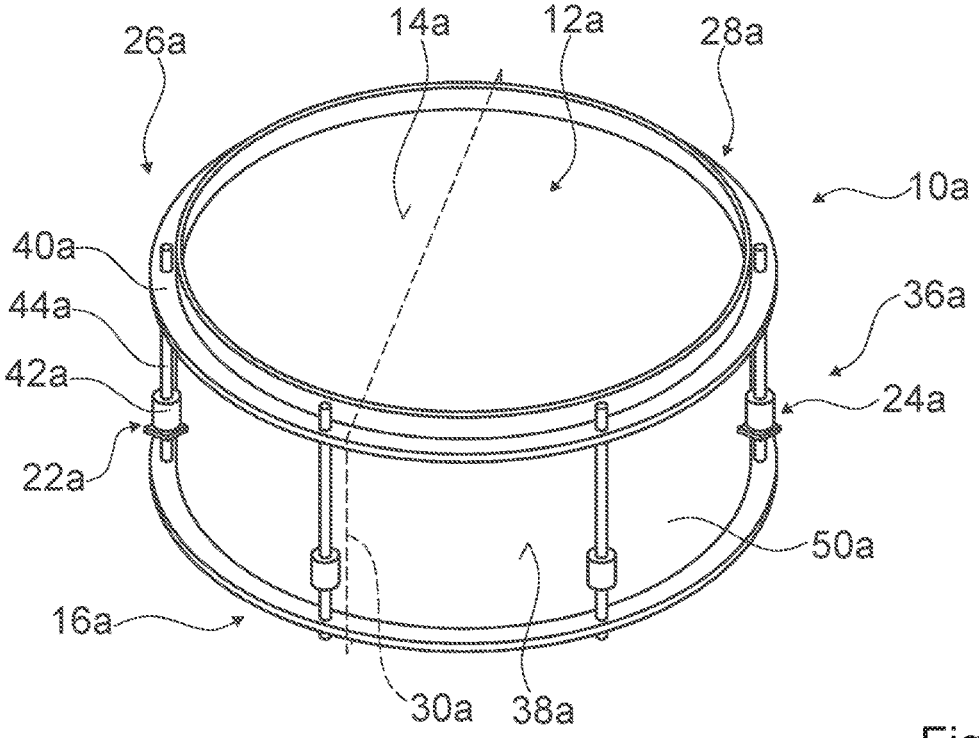

| | | | | |
|---|---|---|---|---|
| 2012/0097009 | A1* | 4/2012 | Eventoff | G10D 13/024<br>84/413 |
| 2014/0260920 | A1* | 9/2014 | Kanayama | G10H 3/146<br>84/730 |

* cited by examiner

PERCUSSION INSTRUMENT AND METHOD FOR DETECTING AN ATTACK POSITION OF A PERCUSSION INSTRUMENT

CROSS REFERENCE TO RELATED APPLICATION

This application is based on and incorporates herein by reference German Patent Application No. 10 2016 110 751.4 filed on Jun. 10, 2016.

STATE OF THE ART

The invention is based on a percussion instrument and on a method for detecting an attack position of a percussion instrument.

From U.S. Pat. No. 5,920,026 A an electronic percussion instrument is known, with a batter head having a main attack surface and with a position detecting unit which is provided to detect an attack position of the main attack surface, a detection of the attack position being effected at least via a centrally arranged position detecting element which is implemented as a head trigger.

The objective of the invention is in particular to provide a generic percussion instrument having improved characteristics regarding detection of a position.

ADVANTAGES OF THE INVENTION

The invention is based on a percussion instrument, in particular an electronic percussion element, with at least one, advantageously exactly one, main attack element having at least one, advantageously exactly one, main attack surface, and with a position detecting unit which is at least provided, in particular in an attack process of the main attack element and in particular of the main attack surface, in particular by means of a hand and/or advantageously of a percussion element, e.g. a drumstick, to detect an attack position of the main attack surface.

It is proposed that the position detecting unit comprises, in particular for the purpose of detecting the attack position, at least two position detecting elements which are arranged, in particular respectively arranged, decentrally with respect to the main attack surface, at least when the main attack surface is viewed perpendicularly. "Provided" is in particular to mean specifically programmed, designed and/or equipped. By an object being provided for a certain function is in particular to be understood that the object fulfills and/or implements said certain function in at least one application state and/or operating state.

The percussion instrument may herein be embodied as any, in particular idiophonic, percussion instrument and/or advantageously membranophonic percussion instrument, e.g. as a cymbal, as a kettledrum and/or preferably as a drum, in particular as a struck drum. In particular, the percussion instrument may herein also be embodied as an acoustical percussion instrument, in particular a traditional acoustical percussion instrument. Preferentially the percussion instrument is embodied as an electronic percussion instrument and particularly preferably as an electronic drum. Furthermore a "main attack element" is in particular to be understood as an element which is advantageously planar and is preferably embodied as a batter head and is in a normal application state provided to be actuated and/or attacked by a user. Preferentially the main attack element is herein embodied as a fabric and/or membrane and in particular consists at least partly, preferably at least to a major part and particularly preferably completely, of paper, of vellum, of plastics, of animal skin and/or in particular of mesh head. The main attack surface of the main attack element furthermore advantageously corresponds to a surface of the main attack element that faces a user. Herein the main attack element and/or at least the main attack surface is advantageously supported in such a way that it is able to oscillate. By the term "at least to a major part" is to be understood in particular by at least 55%, advantageously at least 65%, preferentially at least 75%, particularly preferably at least 85% and especially advantageously at least 95%. The percussion instrument advantageously also comprises at least one holding unit, which is in particular provided at least for holding and advantageously for tensioning the main attack element, and preferably comprises for this purpose at least one, advantageously annulus-shaped base body and/or at least one tensioning element, e.g. at least one tensioning ring, at least one tensioning poppet and/or at least one tensioning screw. The main attack surface of the main attack element is herein different in particular from a rim of the holding unit and/or from the base body of the holding unit.

Furthermore a "position detecting unit" is in particular to be understood as a unit which is at least provided, in particular in an attack process of the main attack element, in particular of the main attack surface, to detect, in particular in a differentiating fashion, and in particular to determine the attack position and/or to provide an evaluation signal for determining the attack position. In particular, the position detecting unit is herein provided to detect at least two, preferably at least four, advantageously no less than eight, particularly preferably at least sixteen and especially advantageously no less than thirty-two different attack positions of the main attack surface in a differentiating fashion, and advantageously to display and/or provide a variety of signals, e.g. acoustical position signals, optical position signals and/or electrical evaluation signals, advantageously depending on a detected attack position. In addition, the position detecting unit may advantageously be provided to detect rim attacks, in particular of the rim of the holding unit and/or of the base body of the holding unit. By a "position detecting element" is furthermore to be understood an element, advantageously an element embodied as a sensor, which in particular comprises an operative connection to the main attack surface and is in particular provided to detect at least one signal that is correlated to the attack position of the main attack surface. In this the position detecting element preferentially need not be in direct contact with the main attack element. The position detecting element could herein be embodied as an optical position detecting element, e.g. as a laser sensor and/or as a light barrier, and/or as an acoustical position detecting element, e.g. as a microphone. Advantageously, however, the position detecting element is embodied as a piezo-electric pick-off and/or signal transducer and comprises in particular at least one, advantageously exactly one, preferably panel-shaped and/or disk-shaped piezo element. Beyond this the position detecting elements are preferably provided to act together to differentiatingly detect an attack position of the main attack surface in particular in an attack process of the main attack element and in particular of the main attack surface. The position detecting elements are herein preferably embodied individually and/or separate from each other and in particular free of shared structural components, e.g. a shared housing. Advantageously the position detecting elements are moreover arranged spaced apart from each other. In particular the position detecting unit could also comprise at least three, at least four, no less than eight, at least sixteen and/or no less than thirty-two position detecting elements, wherein advantageously a respective one of the position detecting elements could be allocated to each determinable attack position. Especially advantageously the position detecting unit comprises precisely two position detecting elements. By an object being "arranged decentrally with respect to the main attack surface, at least when the main attack surface is viewed perpendicularly" is in particular to be understood that, when the main attack surface is viewed perpendicularly, the object is free of intersection points and/or contact points with a center, in particular a geometric center, of the main attack surface. Advantageously all position detecting elements of the position detecting unit are arranged decentrally with respect to the main attack surface, at least when the main attack surface is viewed perpendicularly. Preferably the entire position detecting unit is arranged decentrally with respect to the main attack surface, at least when viewing the main attack surface perpendicularly. Especially advantageously the position detecting elements are herein respectively arranged in a peripheral region of the main attack surface. By way of this implementation, a percussion instrument having improved characteristics regarding a position detection can be made available. In particular, an attack position is herein detectable in an advantageously precise and/or differentiated fashion. Moreover a flexibility and/or efficiency, in particular an efficiency regarding manufacturing, structural components, a construction space and/or costs, may advantageously be improved. Beyond this a damping of the main attack element may advantageously be minimized and/or completely eliminated. Furthermore a particularly authentic impact on a sound is achievable, in particular when using electronic percussion elements. In addition peripheral attacks, e.g. "rim shots", "rim clicks" or "side sticks" are also advantageously detectable.

Preferably the position detecting elements are arranged, at least when the main attack surface is viewed perpendicularly, in peripheral regions of the main attack surface which are situated at least substantially opposite each other. In this context, by "peripheral regions situated at least substantially opposite each other" in particular peripheral regions of the main attack surface are to be understood which have from opposite peripheral regions of the main attack surface, in particular from directly opposite peripheral regions of the main attack surface, a minimum distance of maximally 15%, advantageously no more than 10%, preferably maximally 5% and especially preferentially no more than 2% of a maximum longitudinal extension, advantageously a diameter, of the main attack surface. Particularly preferably the position detecting elements are herein arranged directly opposite each other with respect to the main attack surface. By a first position detecting element and a second position detecting element "being arranged directly opposite each other with respect to the main attack surface" is in particular to be understood that the first position detecting element and the second position detecting element are arranged in such a way that there is at least one straight line going through a center, in particular a geometric center, of the first position detecting element, through a center, in particular a geometric center, of the main attack surface and through a center, in particular a geometric center, of the second position detecting element, at least when the main attack surface is viewed perpendicularly. This allows determining an attack position of the main attack surface in an advantageously simple fashion.

It is further proposed that the position detecting elements are arranged at least substantially mirror-symmetrically with respect to a mirror plane which is oriented perpendicularly to the main attack surface. Herein the mirror plane is advantageously a middle plane which in particular extends through the center, in particular the geometric center, of the main attack surface. By an object being implemented "at least substantially mirror-symmetrically" with respect to a mirror plane is in particular to be understood that the object differs from a reference object that is mirror-symmetrical to the mirror plane by a volume portion of maximally 15%, advantageously maximally 10%, preferentially no more than 5% and particularly preferably maximally 2%. This allows achieving an advantageously simple structural implementation. Moreover advantageously a determination of an attack position of the main attack surface can be further simplified.

If the position detecting elements are free of a contact with the main attack surface, in particular at least during an attack process of the main attack element and in particular of the main attack surface, and particularly preferably continuously, a damping of the main attack surface, and hence in particular the main attack surface, and in particular a thereto connected influence on the main attack surface may advantageously be prevented.

In a preferred embodiment of the invention it is proposed that the position detecting elements are provided, in particular for the purposes of detecting the attack position, in particular in an attack process of the main attack element and in particular of the main attack surface, to detect an oscillation, in particular an oscillation of the main attack element and/or of the holding unit, which is correlated to the attack position. This allows improving in particular a position detection.

An advantageously strong signal for detecting an attack position of the main attack surface is in particular achievable if the position detecting elements each comprise at least one piezo element, each of the piezo elements having in an assembled state a deformation direction which is at least substantially perpendicular to the main attack surface. Advantageously the piezo elements are herein embodied plate-shaped and/or disk-shaped and in particular comprise a main extension plane which is at least substantially parallel to the main attack surface. In this context the term "at least substantially perpendicular" is in particular to mean an orientation of a direction with respect to a reference direction, wherein the direction and the reference direction include, in particular viewed in a plane, an angle in particular between 82° and 98°, advantageously between 85° and 95° and particularly preferably between 88° and 92°. "At least substantially parallel" is herein to mean in particular an orientation of a direction with respect to a reference direction, in particular in a plane, wherein the direction has a deviation from the reference direction of in particular less than 8°, advantageously less than 5° and especially advantageously less than 2°. Furthermore, by a "main extension plane" of an object in particular a plane is to be understood which is parallel to a greatest lateral surface of a smallest, in particular imaginary, rectangular cuboid which just still entirely encloses the object and which advantageously extends through a center, in particular a geometrical center, of the rectangular cuboid.

It is also proposed that the position detecting elements are at least substantially structurally identical. Herein the term "at least substantially structurally identical" is in particular to mean structurally identical, not considering production tolerances and/or in the range of production-technical feasibilities and/or in the range of standardized tolerances. This allows advantageously simplifying an evaluation algorithm. Moreover costs are advantageously reducible.

In a further implementation of the invention it is proposed that the percussion instrument comprises at least one holding unit, in particular the aforementioned holding unit, which is provided at least for holding the main attack element, wherein the position detecting elements are provided, in particular in an attack process of the main attack element, in particular of the main attack surface, to detect an oscillation at the holding unit that is correlated to the attack position. In particular the position detecting elements are in this case provided to detect, in particular in an attack process, an oscillation correlated to the attack position and transferred onto the holding unit via the main attack surface. This allows in particular achieving an advantageously cost-favorable position detection, wherein a damping of the main attack element is advantageously at least reducible and/or is advantageously entirely avoidable.

Moreover it is proposed that the position detecting elements are arranged in a region of the holding unit that differs from an inner side of the holding unit, in particular from an inner side of the, advantageously annulus-shaped, base body. Herein at least one of the position detecting elements may be integrated in the holding unit, in particular in a wall of the, advantageously annulus-shaped, base body, advantageously in a recess, a hollow and/or a cavity of the holding unit, in particular of the base body. Beyond this at least one of the position detecting elements may be arranged on an outer side of the holding unit, in particular an outer side of the, advantageously annulus-shaped, base body. In this case the holding unit may additionally comprise at least one cover blind provided for covering the position detecting element, which is in particular arranged on the outer side of the holding unit, in particular the outer side of the, advantageously annulus-shaped, base body. Preferably the position detecting elements are arranged in equivalent regions of the holding unit, wherein the position detecting elements, in particular all position detecting elements are advantageously integrated in the holding unit or arranged on the outer side of the holding unit. In this way an implementation is achievable which is advantageously efficient regarding construction space and/or structural components. Furthermore, an advantageous retrofit capability is achievable, in particular in case of the position detecting elements being arranged on the outer side of the holding unit. Moreover an optical image of the percussion instrument is advantageously enhanceable.

It is moreover proposed that the holding unit comprises at least one tensioning element, in particular the afore-mentioned tensioning element, which is provided for tensioning the main attack element, at least one of the position detecting elements being arranged at the tensioning element. In particular the position detecting element could in this case be arranged on a tensioning element that is embodied as a tensioning ring and/or on a tensioning element that is embodied as a tensioning screw. Advantageously, however, the position detecting element ins arranged on, advantageously fixated to, a tensioning element that is embodied as a tensioning poppet. Advantageously the position detecting elements, in particular all position detecting elements, are arranged on, advantageously fixated to, different tensioning elements, preferably different tensioning elements that are embodied as tensioning poppets. This allows achieving an advantageously simple fixation of the position detecting elements.

A further aspect of the invention relates to a system with at least one percussion instrument, as has been described above, and with at least one evaluation unit which is connected to the position detecting unit and is provided, in particular in an attack process, at least for a determination, in particular detection and/or localization, of an attack position of the main attack surface, in particular by means of at least one evaluation signal supplied by the position detecting unit. By an "evaluation unit" is herein to be understood in particular an electric and/or electronic unit which comprises at least evaluation electronics and is provided to detect, process and/or interpret at least one evaluation signal provided by the position detecting unit. In particular, the evaluation unit is herein implemented extra and/or separately from the percussion instrument, e.g. being part of a sound generator and/or amplifier and/or being integrated in a sound generator and/or amplifier. This in particular allows achieving a particularly easy evaluation of an attack position.

It is further proposed that the evaluation unit is provided, for the purpose of determining the attack position, to take into account at least one wavelength characteristic, which is correlated to the attack position, of an oscillation, in particular of an oscillation of the main attack element and/or of the holding unit. By a "wavelength characteristic" is in particular a characteristic to be understood which is in particular correlated to a wavelength of the oscillation. Advantageously the evaluation unit is able, at least on the basis of the wavelength characteristic, to deduct a presence and/or a position of an attack, in particular of the main attack surface, and/or to determine the presence and/or the position of the attack, in particular of the main attack surface. Advantageously the wavelength characteristic herein corresponds to at least one, advantageously precisely one detection value representing and/or characterizing the wavelength of the oscillation, in particular a detection value detected by means of the position detecting elements. Particularly preferably the wavelength characteristic corresponds to a length, in particular a time length and advantageously a length standardized via a position of the respective position detecting element, of a half-wave of the oscillation, and/or corresponds to a mean value of a first half-wave of the oscillation detected via a first one of the position detecting elements and a second half-wave of the oscillation detected via a second one of the position detecting elements. This allows detecting an attack position in an advantageous manner.

In addition or as an alternative it is proposed that the evaluation unit is provided, for the purpose of determining the attack position, to take into account at least one runtime characteristic of an oscillation that is correlated to the attack position, in particular of an oscillation of the main attack element and/or of the holding unit. By a "runtime characteristic" is in particular a characteristic to be understood which is correlated in particular to a runtime of the oscillation and advantageously to a runtime difference of the oscillation between the position detecting elements. Advantageously the evaluation unit is able to deduct, at least on the basis of the runtime characteristic, a presence and/or a position of an attack, in particular of the main attack surface, and/or to determine the position of the attack, in particular of the main attack surface. Advantageously the runtime characteristic herein corresponds to at least one, advantageously precisely one, detection value representing and/or characterizing the runtime of the oscillation and advantageously the runtime difference of the oscillation between the position detecting elements, which detection value is in particular detected via the position detecting elements. Particularly preferably the runtime characteristic corresponds to a period, in particular time period, between an attack happening, in particular of the main attack surface, and an oscillation correlated to the attack being detected via the position detecting elements, and/or to a period, in particular time period, between a detection of an oscillation correlated to an attack via a first one of the position detecting elements and a detection of the oscillation correlated to the attack via a second one of the position detecting elements. This allows in particular further improving an accuracy of a detection of an attack position.

According to an especially preferred implementation of the invention, it is proposed that the evaluation unit is provided to modify, in at least one operating state, an evaluation method for determining the attack position, depending on a value of the runtime characteristic. Advantageously the evaluation unit is herein provided, for a value of the runtime characteristic below a limit value that is in particular set and/or settable, to take into account and/or use for determining the attack position a wavelength characteristic weighted by way of the runtime characteristic. Moreover the evaluation unit is herein preferentially provided, for a value of the runtime characteristic above a limit value, advantageously the same limit value, to take into account and/or use for determining the attack position an unweighted wavelength characteristic. In this way an especially accurate position detection may be realized.

The invention is furthermore based on a method for the detection of an attack position of a percussion instrument, in particular an electronic percussion instrument, the percussion instrument comprising at least one, advantageously precisely one, main attack element which has at least one, advantageously precisely one, main attack surface.

It is proposed that, in particular in an attack process of the main attack element and in particular of the main attack surface, an attack position of the main attack surface is detected by at least two position detecting elements which are arranged decentrally with respect to the main attack surface, at least when the main attack surface is viewed perpendicularly. This allows in particular improving a position detection as well as detecting an attack position in an advantageously accurate and/or differentiated fashion. Moreover a flexibility and/or an efficiency, in particular an efficiency with respect to manufacturing, structural components, construction space and/or costs, can be enhanced in an advantageous manner. Beyond this a damping of the main attack element may be advantageously minimized and/or fully eliminated. Furthermore, in particular when using electronic percussion instruments, an especially authentic impact on a sound is achievable. Furthermore peripheral attacks, e.g. "rim shots", "rim clicks" respectively "side sticks" are advantageously detectable. Moreover, at least one attack-position correlated wavelength characteristic and/or runtime characteristic of an oscillation, in particular of the main attack element and/or of the holding unit, which is correlated to the attack position is taken into account for the purpose of determining the attack position.

The percussion instrument and the method for the detection of an attack position of the percussion instrument are herein not to be restricted to the above-described application and implementation form. In particular, for fulfilling a functionality herein described, the percussion instrument and the method for the detection of an attack position of the percussion element may have a number of respective elements, structural components and units that differs from the number herein mentioned.

DRAWINGS

Further advantages may arise from the following description of the drawings. In the drawings exemplary embodiments of the invention are presented. The drawings, the description and the claims contain a plurality of features in combination. The person having ordinary skill in the art will purposefully also consider the features separately and will find further expedient combinations.

Figure 2:
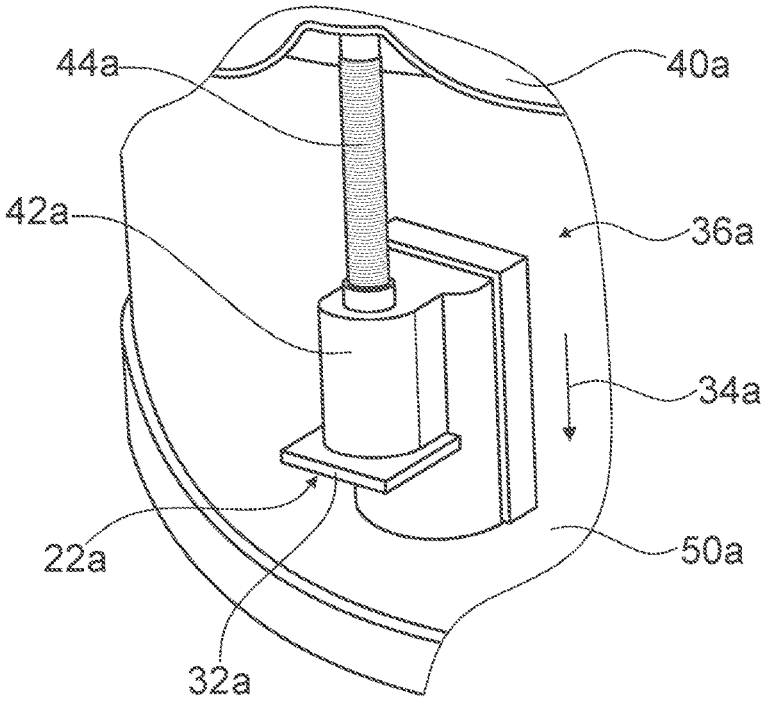
Figure 3:
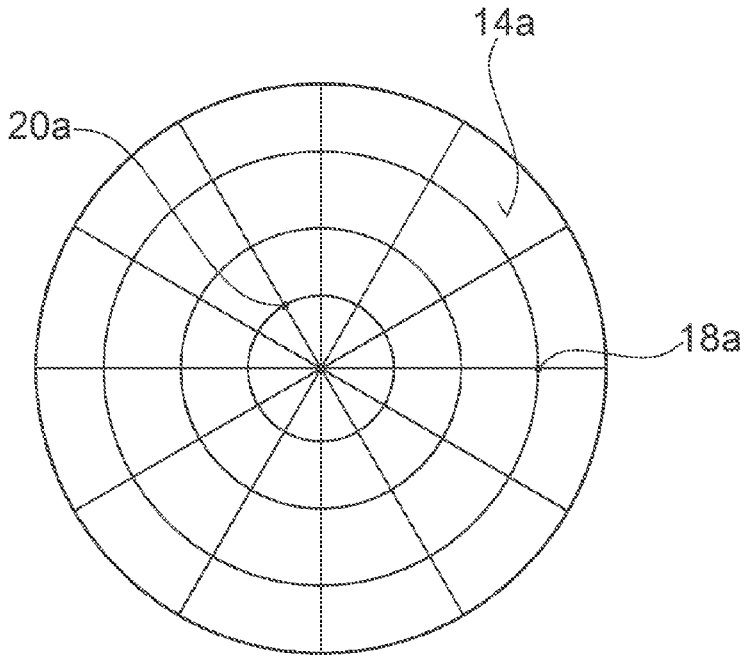
Figure 4:
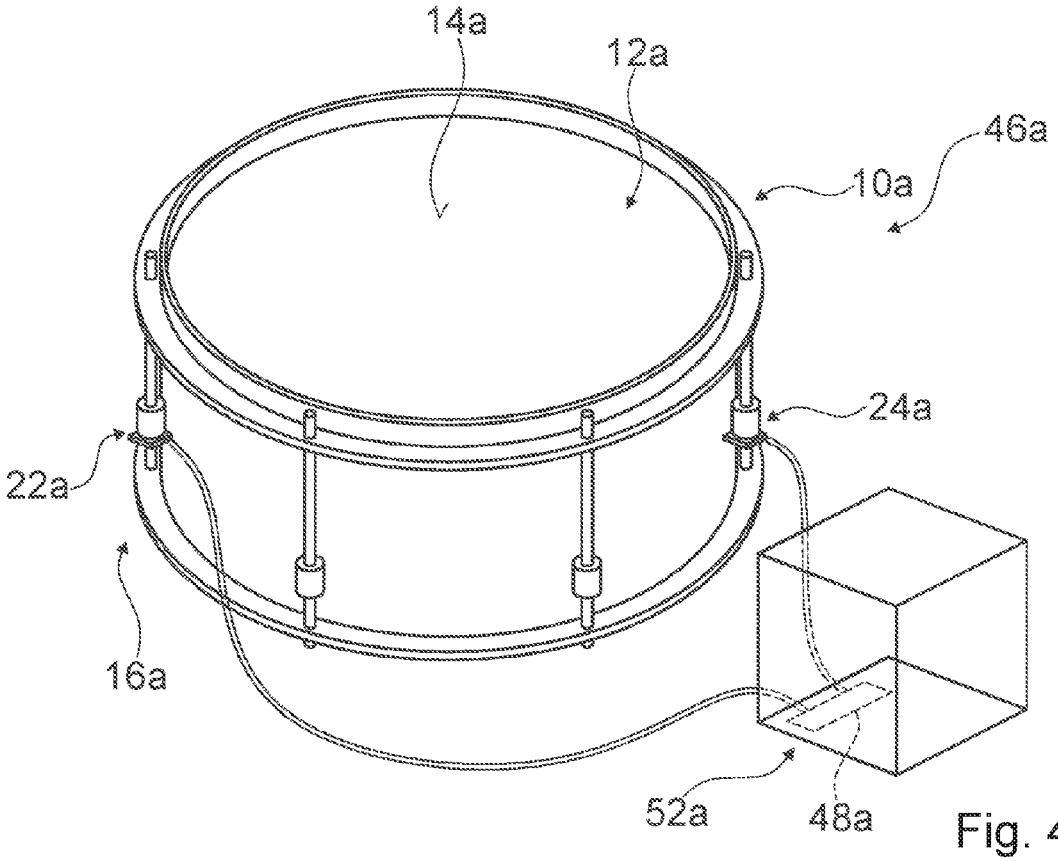
Figure 5:
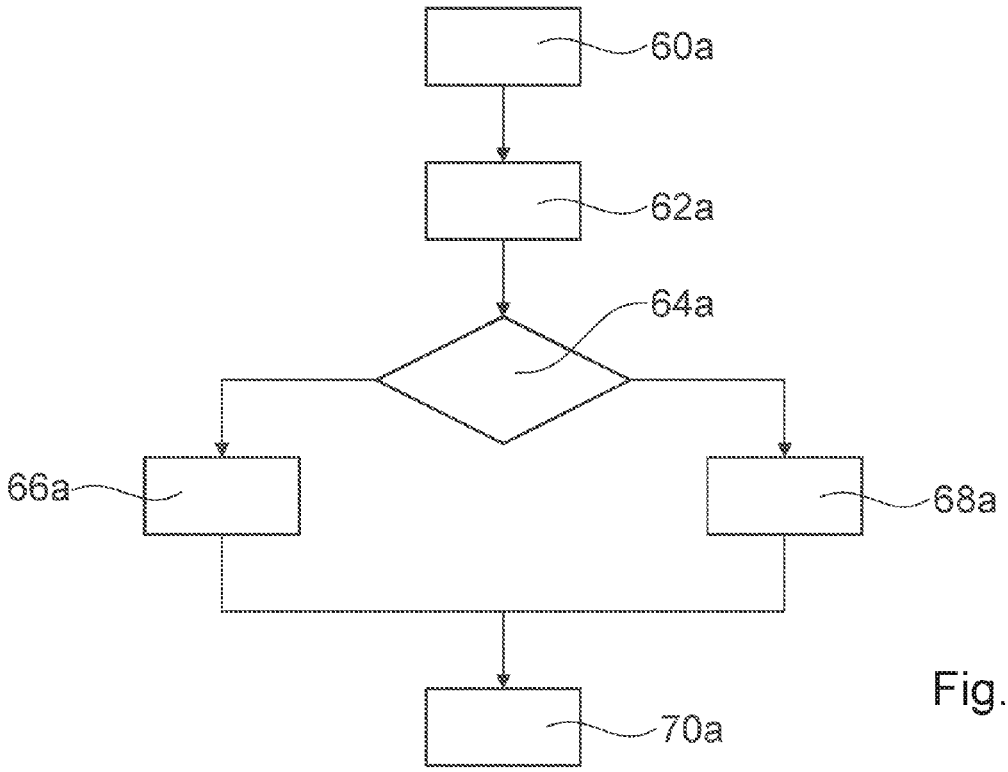
Figure 6:
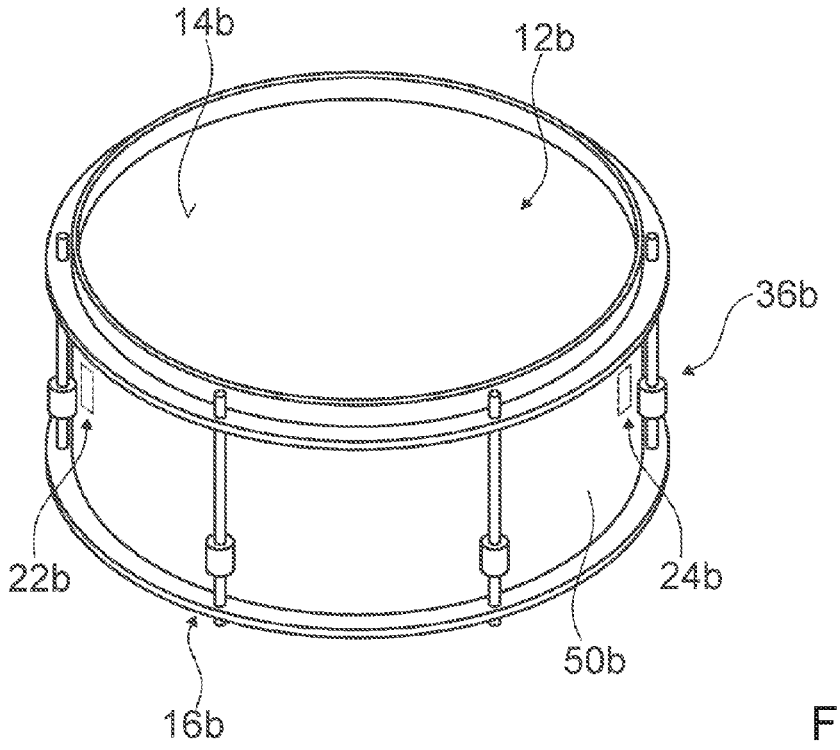

It is shown in:

FIG. 1 a percussion instrument exemplarily embodied as an electronic percussion instrument, with a position detecting unit, in a perspective view, FIG. 2 an enlarged presentation of a position detecting element of the position detecting unit, FIG. 3 a presentation of attack positions which are detectable via the position detecting unit, FIG. 4 a system with the percussion instrument of FIG. 1 and with an evaluation unit, in a schematic presentation, FIG. 5 an exemplary flow diagram for the detection of an attack position of a percussion instrument, and FIG. 6 a further exemplary embodiment of a percussion instrument, with a position detecting unit, in a perspective view.

DESCRIPTION OF THE EXEMPLARY EMBODIMENTS

FIG. 1 shows a percussion instrument 10*a*, which is embodied as an electronic percussion instrument, in a perspective view. The percussion instrument 10*a* is herein exemplarily embodied as an electronic drum, in the present case in particular as a small drum ("snare drum"). Alternatively, a percussion instrument could, however, also be embodied as any other percussion instrument, e.g. as a kettle drum and/or a cymbal. Moreover a percussion instrument could principally also be embodied as an acoustical percussion instrument, in particular a traditional acoustical percussion instrument.

The percussion instrument 10*a* comprises a main attack element 12*a*. The main attack element 12*a* is implemented in single-ply fashion. Alternatively, a main attack element could also be implemented in multiple-ply, e.g. double-ply fashion. The main attack element 12*a* is embodied as a membrane, in particular a tensioned membrane. The main attack element 12*a* is made of plastics. The main attack element 12*a* is in the present case implemented as a batter head. The main attack element 12*a* is in a usual application state provided to be activated and/or attacked by a user, in particular for indirectly creating an acoustical signal.

For this purpose the main attack element 12*a* comprises a main attack surface 14*a*. The main attack surface 14*a* corresponds to a surface of the main attack element 12*a* that faces a user. The main attack surface 14*a* is in the present case circular. Moreover the main attack surface 14*a* is supported in such a way that it is able to oscillate. Alternatively, however, a main attack element could also be made of any material differing from plastics. It is moreover conceivable to implement a main attack surface rectangular and/or oval.

The percussion instrument 10*a* further comprises a holding unit 36*a*. The holding unit 36*a* is provided to hold the main attack element 12*a*. For this purpose the holding unit 36*a* comprises a base body 50*a*. The base body 50*a* forms a corpus of the percussion instrument 10*a*. The base body 50*a* is adapted to a shape and/or contour of the main attack element 12*a*. The base body 50*a* is herein embodied corresponding to the main attack surface 14*a*. The base body 50*a* is embodied as a hollow body. The base body 50*a* is embodied as a hollow cylinder, in particular circular cylinder, and/or as a ring, in particular as an annulus. The base body 50*a* is in the present case embodied as a kettle. Furthermore the base body 50*a* is made of metal, e.g. of steel and/or brass. In an assembled state the base body 50*a* contacts the main attack element 12*a* directly. The base body 50*a* is provided for supporting the main attack element 12*a*, in particular receiving a weight force of the main attack element 12*a*. Alternatively it is conceivable to embody a holding unit, in particular a base body, and a main attack element in a one-part implementation. Principally it is also conceivable to entirely dispense with a holding unit. A base body could furthermore also have a contour and/or shape of a rectangular cuboid and/or could be embodied as a full body. Moreover a base body could principally also be made of any material differing from metal, e.g. plastics, wood and/or acrylic glass.

In addition to this, the holding unit 36*a* is provided for tensioning the main attack element 12*a* and in particular the main attack surface 14*a*. For this purpose the holding unit 36*a* comprises at least one tensioning element 40*a*, 42*a*, 44*a*. In the present case the holding unit 36*a* comprises at least three tensioning elements 40*a*, 42*a*, 44*a*, which are implemented differing. The holding unit 36*a* herein comprises three groups of tensioning elements 40*a*, 42*a*, 44*a*.

A first group of the groups of tensioning elements 40*a*, 42*a*, 44*a* comprises exactly one first tensioning element 40*a*. The first tensioning element 40*a* is adapted to a shape and/or contour of the base body 50*a* and/or of the main attack element 12*a*. The first tensioning element 40*a* is herein embodied corresponding to the main attack surface 14*a*. The first tensioning element 40*a* is embodied at least substantially ring-shaped. The first tensioning element 40*a* is embodied as a tensioning ring. Furthermore the first tensioning element 40*a* is made of metal. Alternatively a first tensioning element could also be made of wood and/or plastics. The first tensioning element 40*a* is in an assembled state arranged on a side of the holding unit 36*a* that faces the main attack element 12*a*. The first tensioning element 40*a* forms a rim of the holding unit 36*a*. The first tensioning element 40*a* contacts in an assembled state the main attack element 12*a* directly. The first tensioning element 40*a* is herein provided to hold the main attack element 12*a* to the base body 50*a* and/or to press it against the base body 50*a*.

A second group of the groups of tensioning elements 40*a*, 42*a*, 44*a* comprises a plurality of second tensioning elements 42*a*, wherein, for the sake of clarity, only one of the second tensioning elements 42*a* is given a reference numeral in FIG. 1. In the present case the second group of the groups of tensioning elements 40*a*, 42*a*, 44*a* comprises precisely six second tensioning elements 42*a*. Alternatively a second group of the groups of tensioning elements could also comprise any other number of second tensioning elements 42*a*. The second tensioning elements 42*a* are at least substantially structurally identical. The second tensioning elements 42*a* are arranged, in particular fixated, on an outer side 38*a* of the holding unit 36*a*, in particular of the base body 50*a*. The second tensioning elements 42*a* are made of metal. The second tensioning elements 42*a* are embodied as tensioning poppets. The second tensioning elements 42*a* are in the present case connected to the base body 50*a* at least by substance-to-substance bond. Alternatively it is conceivable to implement second tensioning elements in such a way that they are connected to a base body in a force-fit and/or form-fit manner. Second tensioning elements could also be embodied in a one-part implementation with a base body. Moreover second tensioning elements could also be made of wood and/or plastics.

A third group of the groups of tensioning elements 40*a*, 42*a*, 44*a* comprises a plurality of third tensioning elements 44*a*, wherein in particular in FIG. 1 only one of the third tensioning elements 44*a* is given a reference numeral for the sake of clarity. In the present case the third group of the groups of tensioning elements 40*a*, 42*a*, 44*a* comprises exactly six third tensioning elements 44*a*. However, as an alternative, a third group of the groups of tensioning elements could also comprise any other number of third tensioning elements. The third tensioning elements 44*a* are at least substantially structurally identical. The third tensioning elements 44*a* are arranged on the outer side 38*a* of the holding unit 36*a*, in particular of the base body 50*a*. The third tensioning elements 44*a* are made of metal. The third tensioning elements 44*a* are embodied as tensioning screws. Each of the third tensioning elements 44*a* is herein allocated to exactly one of the second tensioning elements 42*a*. Moreover each of the third tensioning elements 44*a* is allocated to the first tensioning element 40*a*. The third tensioning elements 44*a* connect in an assembled state the first tensioning element 40*a* to the second tensioning elements 42*a*.

The tensioning elements 40*a*, 42*a*, 44*a* are in the present case provided to act together for tensioning the main attack element 12*a*. The main attack element 12*a* can herein be tensioned via the third tensioning elements 44*a*, in particular manually by a user. Alternatively it is conceivable to do without at least one group of tensioning elements and/or to use tensioning elements which differ from the disclosed tensioning elements. It is also conceivable to entirely dispense with tensioning elements, in particular if a main attack element with an at least substantially dimensionally stable main attack surface is used.

The percussion instrument 10*a* further comprises a position detecting unit 16*a*. The position detecting unit 16*a* is provided to detect, in an attack process of the main attack surface 14*a*, an attack position 18*a*, 20*a* of the main attack surface 14*a*. The position detecting unit 16*a* is moreover provided to detect rim attacks on the edge of the holding unit 36*a*.

For this purpose the position detecting unit 16*a* comprises at least two position detecting elements 22*a*, 24*a*. In the present case the position detecting unit 16*a* comprises exactly two position detecting elements 22*a*, 24*a*. The position detecting elements 22*a*, 24*a* are embodied extra with respect to each other. The position detecting elements 22*a*, 24*a* are embodied separate from each other. The position detecting elements 22*a*, 24*a* are herein free of shared structural components, in particular of a shared housing. The position detecting elements 22*a*, 24*a* are arranged spaced apart from each other.

When the main attack surface 14*a* is viewed perpendicularly, the position detecting elements 22*a*, 24*a* are arranged decentrally with respect to the main attack surface 14*a*. The position detecting elements 22*a*, 24*a* are herein respectively arranged in a peripheral region 26*a*, 28*a* of the main attack surface 14*a*, in the present case in particular directly opposite peripheral regions 26*a*, 28*a* of the main attack surface 14*a*. The position detecting elements 22*a*, 24*a* are arranged mirror-symmetrically with respect to a mirror plane 30*a* which extends through the center, in particular the geometric center, of the main attack surface 14*a* and is oriented perpendicularly to the main attack surface 14*a*.

In the present case the position detecting elements 22*a*, 24*a* are arranged on the holding unit 36*a*. The position detecting elements 22*a*, 24*a* are thus arranged spaced apart from the main attack element 12*a* and/or the main attack surface 14*a*. The position detecting elements 22*a*, 24*a* are herein continuously free of a contact with the main attack surface 14*a*. Furthermore the position detecting elements 22*a*, 24*a* are at least substantially structurally identical. Alternatively it is conceivable to implement position detecting elements differing from each other. Beyond this, a position detecting unit could also comprise at least three position detecting elements, in particular for the detection of an attack position via triangulation, and/or at least four position detecting elements, which could in particular be arranged in four peripheral regions of a main attack surface respectively including an angle range of 90° with each other. Beyond this it is conceivable that a position detecting unit comprises precisely one position detecting element for each detectable attack position. Additionally the position detecting unit could principally also comprise at least one position detecting element which is arranged centrally with respect to the main attack surface, at least when the main attack surface is viewed perpendicularly.

In the following a first position detecting element 22*a* of the position detecting elements 22*a*, 24*a* is described in detail referring to FIG. 2 wherein, in particular due to the at least substantially structurally identical implementation of the position detecting elements 22*a*, 24*a*, the following description may be also applied to the other position detecting element 22*a*, 24*a*, in particular a second position detecting element 24*a* of the position detecting elements 22*a*, 24*a*.

The first position detecting element 22*a* is in the present case embodied as a piezo electric pick-off. Herein the first position detecting element 22*a* comprises at least one piezo element 32*a*. In the present case the first position detecting element 22*a* comprises exactly one piezo element 32*a*. The piezo element 32*a* is embodied plate-shaped. The piezo element 32*a* is herein implemented as a piezo platelet. The piezo element 32*a* is herein arranged in such a way that a deformation direction 34*a* of the piezo element 32*a* is in the assembled state at least substantially perpendicular to the main attack surface 14*a*.

The first position detecting element 22*a* is moreover arranged on the outer side 38*a* of the holding unit 36*a*, in particular of the base body 50*a*. The first position detecting element 22*a* is arranged at one of the tensioning elements 40*a*, 42*a*, 44*a*. In the present case the first position detecting element 22*a* is arranged at one of the second tensioning elements 42*a*, which are in particular embodied as tensioning poppets. In the present case the first position detecting element 22*a* is arranged on a side of the second tensioning element 42*a* that faces away from the main attack surface 14*a*. The first position detecting element 22*a* is in the present case connected to the second tensioning element 42*a* at least by substance-to-substance bond. Alternatively it is conceivable to connect a position detecting element to a tensioning element in a force-fit and/or form-fit manner and/or to arrange it at another point of a holding unit, in particular of a base body of the holding unit, e.g. on a side of the holding unit, in particular of the base body, that faces towards and/or away from a main attack surface. Furthermore a position detecting element could principally also be embodied in a one-part implementation with a holding unit, in particular with a tensioning element and/or a base body. Beyond this a position detecting element could also comprise several piezo elements and/or could be implemented as an optical position detecting element, e.g. as a laser sensor and/or light barrier, and/or as an acoustical position detecting element, e.g. as a microphone. It is additionally conceivable to cover a position detecting element with a cover blind.

In the present case the position detecting unit 16*a* is provided, in particular via the position detecting elements 22*a*, 24*a*, for detecting at least forty-nine different attack positions 18*a*, 20*a* of the main attack surface 14*a*. In FIG. 3 the attack positions 18*a*, 20*a* are herein depicted as intersection points of radially outwards running lines and circle lines, wherein—in particular for the sake of better overview—only two of the attack positions 18*a*, 20*a* are provided with reference numerals.

The position detecting elements 22*a*, 24*a* are provided to act together for detecting the attack positions 18*a*, 20*a* of the main attack surface 14*a* in an attack process of the main attack element 12*a*, in particular of the main attack surface 14*a*. Herein the position detecting elements 22*a*, 24*a* are respectively provided for detecting in an attack process of the main attack element 12*a*, in particular of the main attack surface 14*a*, an oscillation that is correlated with the attack position 18*a*, 20*a*, in the present case in particular at the holding unit 36*a*. The position detecting elements 22*a*, 24*a* are moreover provided to supply an evaluation signal, in particular an electric evaluation signal, that is correlated with the oscillation.

FIG. 4 shows a system 46*a* with the percussion instrument 10*a* and an evaluation unit 48*a* for detecting an attack position 18*a*, 20*a* of the main attack surface 14*a*. The evaluation unit 48*a* is embodied extra and/or separate from the percussion instrument 10*a*. Alternatively it is however also conceivable to integrate an evaluation unit in a percussion instrument, advantageously in a holding unit and particularly preferably in a base body of the holding unit. The evaluation unit 48*a* comprises a connection to the percussion instrument 10*a*, in the present case in particular to each of the position detecting elements 22*a*, 24*a*.

The evaluation unit 48*a* is furthermore implemented as an electronics unit. The evaluation unit 48*a* comprises evaluation electronics (not shown) for detecting, processing and/or interpreting the evaluation signal, which has in particular been supplied by the position detecting elements 22*a*, 24*a*. The evaluation unit 48*a* further comprises a connection to a sound generator 52*a*. In the present case the evaluation unit 48*a* is in particular integrated in the sound generator 52*a*. The sound generator 52*a* is provided for generating different acoustical signals depending on different attack positions 18*a*, 20*a*. Alternatively, however, a sound generator could also be dispensed with. In this case the evaluation unit could, for example, be connected to an illumination unit, which could in particular be provided for generating different optical signals depending on the different attack positions. The evaluation unit could also be connected to a tuning device, which could in particular be provided for generating different optical signals depending on the different attack positions, as a result of which advantageously a tuning of the percussion instrument and/or a tensioning of a main attack element is optimizable.

In the present case the evaluation unit 48*a* is provided for taking into account at least one wavelength characteristic of the oscillation detected by the position detecting elements 22*a*, 24*a* for determining the attack position 18*a*, 20*a*. In the present case the evaluation unit 48*a* is provided for taking into account three different wavelength characteristics.

A first wavelength characteristic of the wavelength characteristics corresponds to a standardized time length of a first half-wave of the oscillation that has been captured and/or detected via the first position detecting element 22*a*. A standardization is herein effected on the basis of a position of the first position detecting element 22*a*.

A second wavelength characteristic of the wavelength characteristics corresponds to a standardized time length of a second half-wave of the oscillation that has been captured and/or detected via the second position detecting element 24*a*. A standardization is herein effected on the basis of a position of the second position detecting element 24*a*.

A third wavelength characteristic of the wavelength characteristics corresponds to a mean value of the first half-wave and the second half-wave of the oscillation.

On the basis of the wavelength characteristics, in particular of a time length of the first half-wave and the second half-wave, the evaluation unit 48*a* is also able to distinguish between attacks of the main attack surface 14*a* and rim attacks of the rim of the holding unit 36*a*. Principally the evaluation unit could also be provided for taking into account a differing number of wavelength characteristics, e.g. precisely one wavelength characteristic, advantageously a third wavelength characteristic and/or two wavelength characteristics, advantageously a first wavelength characteristic and a second wavelength characteristic.

Moreover the evaluation unit 48*a* is provided for taking into account, for determining the attack position 18*a*, 20*a*, at least one runtime characteristic of the oscillation that is correlated to the attack position 18*a*, 20*a* and has been detected by the position detecting elements 22*a*, 24*a*. In the present case the evaluation unit 48*a* is provided for taking into account precisely one runtime characteristic.

The runtime characteristic herein corresponds to a runtime difference, in particular a time period, between a capturing and/or detection of the oscillation via the first position detecting element 22*a* and a capturing and/or detection of the oscillation via the second position detecting element 24*a*.

On the basis of the runtime characteristics, in particular the runtime difference, the evaluation unit 48*a* is herein advantageously able to distinguish between an attack position 18*a* in a peripheral region of the main attack surface 14*a* and an attack position 20*a* in a central region of the main attack surface 14*a*. Principally an evaluation unit could also be provided for taking into account a differing number of runtime characteristics, e.g. two and/or three runtime characteristics, in particular when more than two position detecting elements are used. Beyond this an evaluation unit could, additionally or alternatively, be provided for taking into account at least one amplitude characteristic and/or amplitude correlated to the attack position of an oscillation, in particular an oscillation detected by position detecting elements.

The evaluation unit 48*a* is further provided for modifying and/or changing, in at least one operating state, an evaluation method for determining the attack position 18*a*, 20*a* depending on a value of the runtime characteristic, in the present case in particular a value of the runtime difference. Herein the evaluation unit 48*a* is provided to take into account, and in particular to use for determining an attack position 18*a*, 20*a*, for a value of the runtime characteristic below a limit value, a wavelength characteristic weighted by the runtime characteristic and, for a value of the runtime characteristic above the limit value, an unweighted wavelength characteristic. The evaluation unit 48*a* is thus in the present case provided to carry out a pre-selection by way of the runtime characteristic.

The limit value herein corresponds to between 20% and 60%, advantageously between 30% and 50% of a maximum runtime difference, in particular of a maximally possible runtime difference, between a capturing and/or detection of the oscillation via the first position detecting element 22*a* and a capturing and/or detection of the oscillation via the second position detecting element 22*a*. In the present case the limit value corresponds exemplarily to 0.85 ms, while the maximum runtime difference is 2.32 ms.

The weighted wavelength characteristic corresponds to a temporally weighted mean value of the first half-wave and the second half-wave of the oscillation and results from the following formula:

$$\lambda_{HW,t}=t_1\cdot\lambda_{HW,1}+t_2\cdot\lambda_{HW,2}$$

with $$t_1=\tfrac{1}{2}\cdot(1+\Delta t_{1\text{-}2})$$

and $$t_2=\tfrac{1}{2}\cdot(1-\Delta t_{1\text{-}2}).$$

Herein $\Delta t_{1\text{-}2}$ is a standardized runtime difference between a capturing and/or detection of the oscillation via the first position detecting element 22*a* and a capturing and/or detection of the oscillation via the second position detecting element 24*a*, which is correlated to the runtime characteristic. A standardization is herein effected on the basis of the maximum runtime difference. Furthermore $t_1$ and $t_2$ correspond to a standardized runtime of the oscillation and thus in particular to a time period between an attack of the main attack surface 14*a* happening and a capturing and/or detection of an oscillation correlated to the attack via the respective position detecting element 22*a*, 24*a*. A standardization is also effected on the basis of the maximum runtime difference. Moreover $\lambda_{HW,1}$ corresponds to the first wavelength characteristic and thus in particular to the standardized time length of the first half-wave of the oscillation that has been captured and/or detected via the first position detecting element 22*a*. $\lambda_{HW,2}$ furthermore corresponds to the second wavelength characteristic and thus in particular to the standardized time length of the second half-wave of the oscillation that has been captured and/or detected via the second position detecting element 24*a*.

The unweighted wavelength characteristic furthermore corresponds in the present case to the third wavelength characteristic and thus in particular to the mean value of the first half-wave and the second half-wave of the oscillation. Principally it is however also conceivable to dispense with changing an evaluation method for determining an attack position, in particular to use merely one weighted wavelength characteristic or one unweighted wavelength characteristic.

FIG. 5 shows an exemplary flow chart for detecting and determining an attack position 18*a*, 20*a* of the main attack surface 14*a*.

In a step 60*a* the main attack surface 14*a* is attacked in an attack position 18*a*, 20*a*, as a result of which in particular an oscillation is generated correlated to the attack position 18*a*, 20*a* and depends on the attack position 18*a*, 20*a*.

In a step 62*a* the position detecting elements 22*a*, 24*a* are provided for detecting the oscillation that is correlated to the attack position 18*a*, 20*a* and for respectively transferring an evaluation signal, in particular electrical evaluation signal, correlated to the oscillation onto the evaluation unit 48*a*.

In a step 64*a* the evaluation unit 48*a* carries out a pre-selection depending on the evaluation signals. Herein the evaluation unit 48*a* decides, depending on a value of a runtime characteristic obtained from the evaluation signals, which evaluation method is used for determining the attack position 18*a*, 20*a*.

In case of the value of the runtime characteristic being below a set and/or settable limit value, step 66*a* follows. In step 66*a* the evaluation unit 48*a* is provided for taking into account the wavelength characteristic, in particular the previously mentioned wavelength characteristic, that has been weighted by the runtime characteristic, and for using this in particular for determining the attack position 18*a*, 20*a*.

In case of the value of the runtime characteristic being above the set and/or settable limit value, step 68*a* follows. In step 68*a* the evaluation unit 48*a* is provided to take into account the unweighted wavelength characteristic, in particular the previously mentioned unweighted wavelength characteristic, and for using this in particular for determining the attack position 18*a*, 20*a*.

Independently from a chosen evaluation method, each of steps 66*a* and 68*a* is followed by step 70*a*. In step 70*a* the evaluation unit 48*a* transfers a result signal to the sound generator 52*a*, which is correlated to the determined attack position 18*a*, 20*a*. Herein the sound generator 52*a* generates, depending on the determined attack position 18*a*, 20*a*, an acoustical signal which varies in particular depending on a location of the attack position 18*a*, 20*a*.

The flow chart in FIG. 5 is herein intended to describe, in particular, merely a possible, in particular purely exemplary flow of detecting and determining the attack position 18*a*, 20*a* of the main attack surface 14*a*. In particular, respective steps and/or a sequence of the steps may vary. Herein, for example, step 64*a* could be dispensed with, an evaluation unit using only one evaluation method.

In FIG. 6 a further exemplary embodiment of the invention is shown. The following descriptions and the drawing are substantially restricted to the differences between the exemplary embodiments, wherein regarding identically denominated structural elements, in particular regarding structural elements with the same reference numerals, principally the drawings and/or the description of the other exemplary embodiment of FIGS. 1 to 5 may be referred to. For distinguishing the exemplary embodiments the letter a is set after the reference numerals of the exemplary embodiment in FIGS. 1 to 5. In the exemplary embodiment of FIG. 6 the letter a has been substituted by the letter b.

The further embodiment of FIG. 6 differs from the previous exemplary embodiment at least substantially by an implementation of a position detecting unit 16*b* of a percussion instrument 10*b*.

In this case position detecting elements 22*b*, 24*b* of the position detecting unit 16*b* are integrated in a holding unit 36*b*, in the present case in particular a wall of a base body 50*b*, which in particular allows optimizing a capturing and/or detection of an oscillation via the position detecting elements 22*b*, 24*b*, and advantageously allows improving an optical image of the percussion instrument 10*b*.

The invention claimed is:

1. A percussion instrument, in particular an electronic percussion instrument, comprising:

at least one main attack element having at least one main attack surface;

a position detecting unit which detects an attack position of the main attack surface; and at least one holding unit that holds the main attack element, wherein:

the position detecting unit comprises at least two position detecting elements which are arranged decentrally with respect to the main attack surface, at least when the main attack surface is viewed perpendicularly, the position detecting elements detect an oscillation at the holding unit that is correlated to the attack position, and at least one of the position detecting elements is integrated in the holding unit.

2. The percussion instrument as claimed in claim 1, wherein the position detecting elements are arranged in peripheral regions of the main attack surface which are situated at least substantially opposite each other, at least when the main attack surface is viewed perpendicularly.

3. The percussion instrument as claimed in claim 1, wherein the position detecting elements are arranged at least substantially mirror-symmetrically with respect to a mirror plane which is oriented perpendicularly to the main attack surface.

4. The percussion instrument as claimed in claim 1, wherein the position detecting elements are free of contact with the main attack surface.

5. The percussion instrument as claimed in claim 1, wherein the position detecting elements each comprise at least one piezo element, the piezo element having in an assembled state a deformation direction which is at least substantially perpendicular to the main attack surface.

6. The percussion instrument as claimed in claim 1, wherein the position detecting elements are at least substantially structurally identical.

7. The percussion instrument as claimed in claim 1, wherein at least one of the position detecting elements is arranged on an outer side of the holding unit.

8. The percussion instrument as claimed in claim 1, wherein the holding unit comprises at least one tensioning element that tensions the main attack element, at least one of the position detecting elements being arranged at the tensioning element.

9. A system comprising:

at least one percussion instrument as claimed in claim 1; and at least one evaluation unit, connected to the position detecting unit, which at least determines an attack position of the main attack surface.

10. The system as claimed in claim 9, wherein the evaluation unit in determining the attack position, takes into account at least one wavelength characteristic of an oscillation, which is correlated to the attack position.

11. The system as claimed in claim 9, wherein the evaluation unit in determining the attack position, takes into account at least one runtime characteristic of an oscillation, which is correlated to the attack position.

12. The system as claimed in claim 11, wherein the evaluation unit modifies in at least one operating state an evaluation method for determining the attack position, depending on a value of the runtime characteristic.

13. A method of using a percussion instrument, in particular an electronic percussion instrument, as claimed in claim 1, the method comprising:

detecting an attack position of the main attack position surface by the position detecting unit, including detecting, by the position detecting elements, the oscillation at the holding unit that is correlated to the attack position.

* * * * *